US005595341A

United States Patent [19]

Robinson et al.

[11] Patent Number: 5,595,341

[45] Date of Patent: Jan. 21, 1997

[54] MAILBOX ASSEMBLY AND ASSOCIATED METHODS

[75] Inventors: Larry D. Robinson, Taylorsville, Miss.; James A. Riley, McKeesport, Pa.

[73] Assignee: Artcraft Industries, Inc., Pittsburgh, Pa.

[21] Appl. No.: 442,498

[22] Filed: May 16, 1995

[51] Int. Cl.[6] ..... B65D 91/00

[52] U.S. Cl. ..... 232/17; 232/34

[58] Field of Search ..... 232/17, 38, 34; 446/87, 88; 206/820

[56] References Cited

U.S. PATENT DOCUMENTS

| | | | |
|---|---|---|---|
| D. 337,416 | 7/1993 | Kobilarcik et al. | D99/29 |
| D. 342,366 | 12/1993 | Breen | D99/33 |
| 1,348,767 | 8/1920 | White | 411/353 |
| 2,778,339 | 1/1957 | Liguori | 206/820 |
| 3,013,308 | 12/1961 | Armour | 18/55 |
| 3,825,173 | 7/1974 | Sunday | 232/17 |
| 4,159,770 | 7/1979 | Beyerle . | |
| 4,655,390 | 4/1987 | Martin | 232/35 |
| 4,754,918 | 7/1988 | Rolirad | 232/35 |
| 4,771,941 | 9/1988 | Bowman et al. | 232/35 |
| 4,805,834 | 2/1989 | Saba | 232/34 |
| 4,813,595 | 3/1989 | Johns | 232/38 |
| 4,840,307 | 6/1989 | Hartman | 232/35 |
| 5,060,900 | 10/1991 | Kokoruda | 232/39 |
| 5,076,337 | 12/1991 | Reuter | 232/34 |
| 5,092,517 | 3/1992 | Jeffries, Jr. et al. | 232/35 |
| 5,094,386 | 3/1992 | Tabacco | 232/35 |
| 5,119,986 | 6/1992 | Kobilarcik et al. | 232/35 |
| 5,207,966 | 5/1993 | Adkins et al. | 264/250 |
| 5,273,207 | 12/1993 | Johnson | 232/35 |
| 5,337,954 | 8/1994 | Kobilarcik et al. | 232/38 |
| 5,482,206 | 1/1996 | Waycasy . | |

*Primary Examiner*—Flemming Saether
*Attorney, Agent, or Firm*—Arnold B. Silverman; Eckert Seamans Cherin & Mellott

[57] ABSTRACT

A mailbox assembly and associated methods are disclosed whereby a mailbox housing and a mailbox door are assembled as a unit and the remaining auxiliary components, such as the flag bracket, the latch members, the latch clips, and a push-pin for securing a flag in the flag bracket and to the mailbox housing are unitarily molded and integrally formed on a runner member for ease in manufacturing, and in packaging with the flag and the assembled housing and door unit. The runner member may also have integrally formed and unitarily molded pins located at strategic locations for wedging a flag therebetween to resist damage such as scratching and/or bending, to the flag during shipping and handling of the mailbox assembly. The several auxiliary components with the runner member may be manufactured of a plastic material through an injection molding process. Methods for assembling the mailbox with the auxiliary components and for packaging the mailbox assembly with the flag are also disclosed.

32 Claims, 6 Drawing Sheets

MAILBOX ASSEMBLY AND ASSOCIATED METHODS

BACKGROUND OF THE INVENTION

1. Field of the Invention

The present invention relates to a mailbox assembly in general, and in particular to a rural mailbox and to the manufacture of several auxiliary components for the mailbox and includes methods of assembling the auxiliary components onto the mailbox and of packaging the mailbox assembly.

2. Background of Information

Mailboxes for rural delivery of mail generally have either one or two indicator flags, one flag for indicating to the mail deliverer that mail is present in the mailbox for pick up and the second flag for indicating to the mail recipient, from a remote location, that mail has been delivered.

Some examples of rural mailboxes having one flag indicator means are generally disclosed in U.S. Pat. Nos. 4,754,918; 4,771,941; 4,805,834; 4,840,307; 5,273,207; and 5,094,386. Examples of rural mailboxes having two flag indicator means are generally disclosed in U.S. Pat. Nos. 4,655,390; 5,092,517; and 5,119,986. Some of these references disclose a mailbox with a flag indicator which is automatically actuated upon the opening of the mailbox door for indicating the delivery of mail, and some of these references, such as U.S. Pat. No. 3,825,173 and the aforesaid U.S. Pat. No. 5,119,986 disclose a mailbox having all plastic components. U.S. Pat. No. 3,825,173 discloses the mailbox components as being separately formed and made of a plastic material, and the latter U.S. Pat. No. 5,119,986 discloses the mailbox components, such as the sidewalls, floor, and roof, as being unitarily molded of conventional plastic material.

Most of these rural mailboxes are either bought by the consumer in an assembled form or are bought in a disassembled form where the several components may be individual pieces which are packaged and shipped for assembling by the consumer.

A disadvantage may exist when the mailbox is in a disassembled form in that as the several components are individual pieces and not connected together, these pieces can easily be lost or the appropriate number and/or kind of component necessary for the assembling of the mailbox can easily be excluded from the package so that it may be impossible for the consumer to assemble the mailbox.

Ideally, either some or all of the several mailbox components should, in some fashion or the other, be interconnected with each other so as to avoid these instances from occurring.

U.S. Pat. Nos. 3,013,308 and 5,207,966 disclose methods for molding several elements, but in each of these references, the elements are not used for assembling mailboxes and are of the same kind of element. That is, in U.S. Pat. No. 3,013,308, the element is a dispenser fitment and in U.S. Pat. No. 5,207,966 the element is a blind rivet.

There is, therefore, a need in the an to provide a mailbox and/or a mailbox assembly whereby all of the auxiliary components including an indicator flag are certain to be provided for the assembling of a mailbox by the consumer.

SUMMARY OF THE INVENTION

This invention obviates or at least ameliorates the aforementioned shortcomings of the prior art by providing a mailbox assembly whereby the necessary mailbox auxiliary components such as cooperating latch means, latch clip means, flag bracket means, and fastening means are manufactured such that they are unitarily molded and integrally formed on a runner member. These several auxiliary components remain connected to the runner member until the consumer pulls them off the runner member for assembling the mailbox. Optionally, a flag may be secured to this runner member by fastening means, such as a wire tie, a twist tie, a rubber band, or similar fastening means and/or the runner member may have pins located strategically along its length whereby the flag is nested or wedged therebetween in order to resist damage to the flag during shipment of the mailbox assembly. The runner member with the flag nested thereon can be packaged with a mailbox housing and a mailbox door member, which housing and door member, preferably, are connected as a unit.

The mailbox housing and the mailbox door member have aperture means and the several auxiliary components such as the cooperating latch means and the flag bracket means have pin means which are easily fitted into the aperture means of the mailbox housing and the mailbox door member according to a set of given instructions and/or diagram which may be included in a mailbox assembly kit.

Preferably, the runner member with the several auxiliary components are manufactured of a plastic material through an injection molding process.

In assembling the mailbox, the auxiliary components may systematically be broken off of its respective projection means connected to the runner member and thereafter secured to the mailbox housing and to the mailbox door member in accordance with the given instructions and/or diagram. In packaging the mailbox assembly, a runner member is provided with unitarily molded and integrally formed auxiliary components including pin means which are located at several locations along the runner member, and a flag is wedged between the pin means in order to resist any damage such as scratching and/or bending to the flag especially the flag head during shipment of the mailbox assembly.

Manufacturing the several mailbox auxiliary components integrally with the runner member minimizes the risk of loss of any of these components during packaging and shipping of the mailbox assembly and assures that the appropriate auxiliary component and its required number are provided with the mailbox assembly.

Latch clip members for each of the cooperating latch means are constructed similarly relative to each other and are interchangeable therewith. These latch clip members each have an enclosed elongated slot and a generally opened circular slot for receiving pin elements on the undersurface of the respective latch member. Apertures in the mailbox housing and door member receive the pin elements of the latch members and are engaged by their respective latch clip member for securing the cooperating latch members to the housing and door member.

It is, therefore, an object of the present invention to provide a mailbox having several auxiliary components which are not easily lost and which are easy to manufacture, to package, and to ship as a unit for easy assembling thereof by a consumer.

It is a further object of the present invention to provide a mailbox assembly which eliminates the handling of a plurality of individual auxiliary components and minimizes the risk of an inadequate number of auxiliary components being shipped since the auxiliary components are integrally connected to each other by a main runner member.

A further object of the present invention is to provide in a mailbox assembly a runner member containing several auxiliary components for assembling a mailbox whereby an indicator flag can be secured to the runner member by pin means on the runner member and/or alternately by other fastening means in order to resist damage to the flag during shipment of the mailbox assembly, thereby eliminating the need of additional packaging of the mailbox components.

These and other objects of the present invention will be more fully understood and appreciated from the following description of the invention on reference to the illustrations appended herein.

DESCRIPTION OF THE PREFERRED EMBODIMENT

Figure 1:
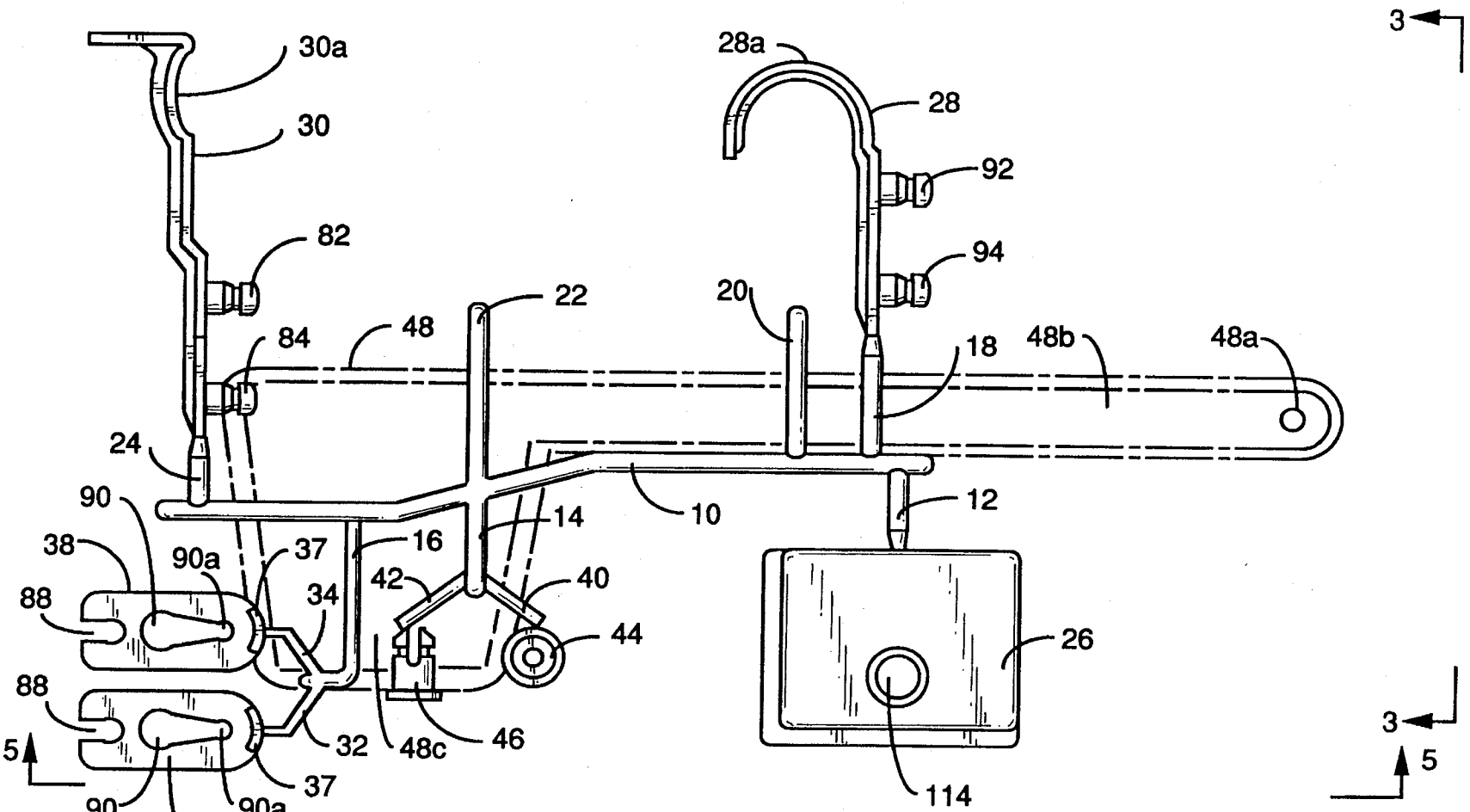
FIG. 1 is a top plan view showing a main runner member of the present invention connected to several auxiliary components, and which runner member and auxiliary components are generally part of a mailbox assembly for the assembling of a mailbox by a consumer.
Figure 2:
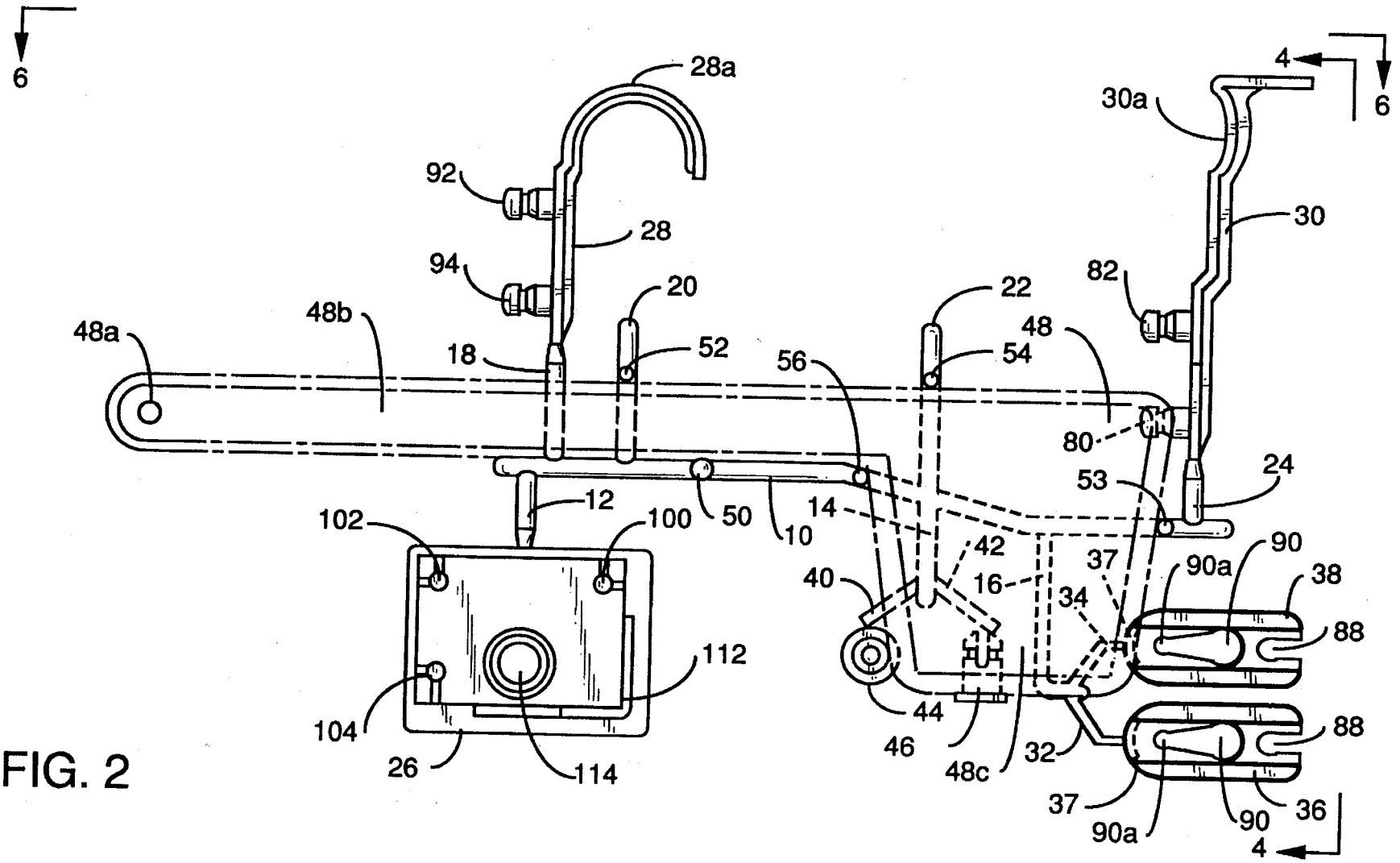
FIG. 2 is a bottom plan view of the runner member of FIG. 1, with the runner member being turned 180° degrees relative to FIG. 1.
Figure 3:
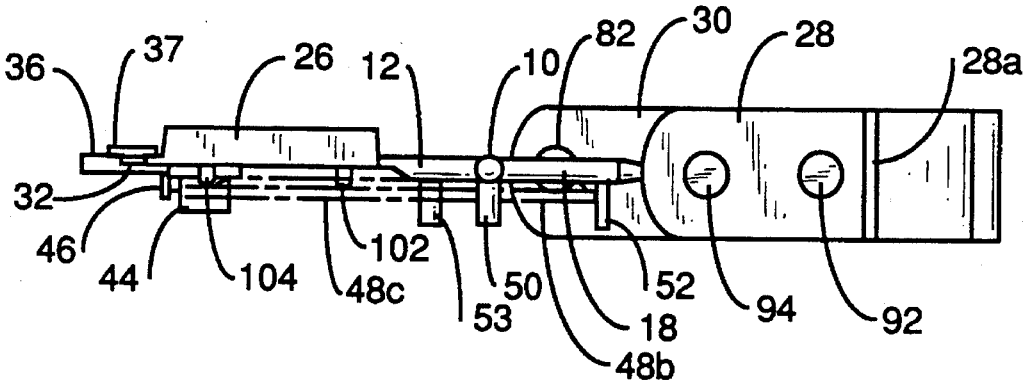
FIG. 3 is a rear elevational view taken along lines 3—3 of FIG. 1.
Figure 4:
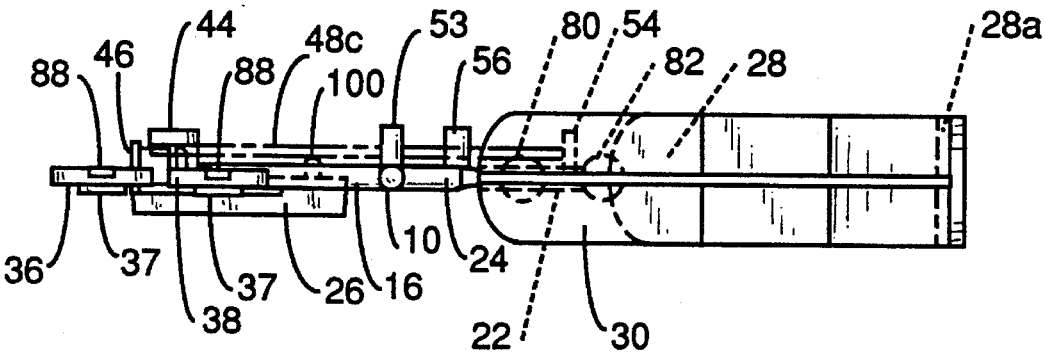
FIG. 4 is a front elevational view taken along lines 4—4 of FIG. 2.
Figure 5:
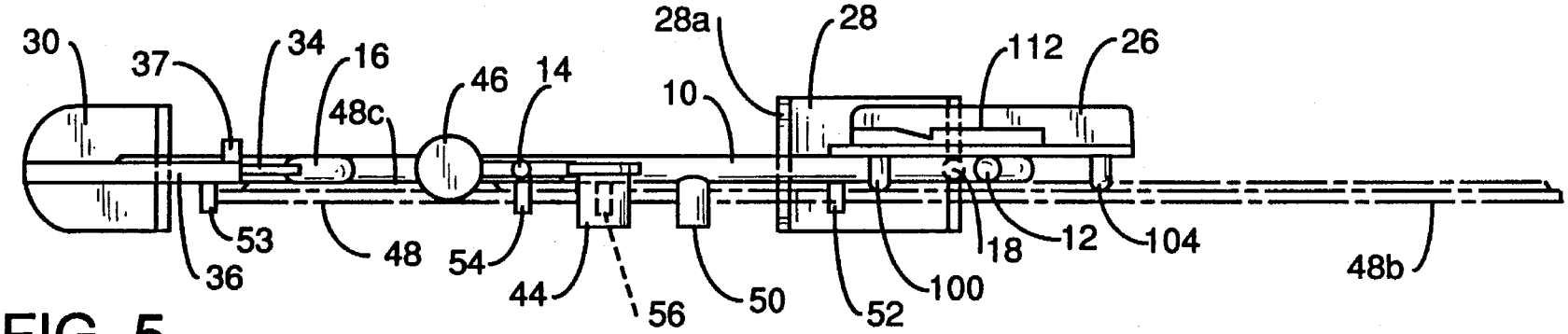
FIG. 5 is a right side elevational view taken along lines 5—5 of FIG. 1.
Figure 6:
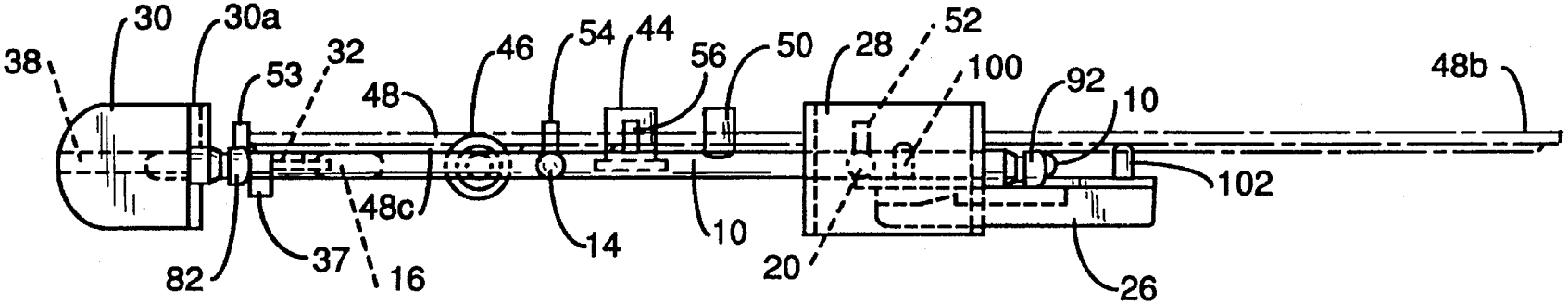
FIG. 6 is a left side elevational view taken along lines 6—6 of FIG. 2.

Referring first to FIGS. 1, 2, 3, 4, 5, 6, and 7, there is shown a main runner member 10. Main runner member 10 has several secondary runners 12, 14, 16, 18, 20, 22, 24, which are an integral part of main runner member 10. Integrally connected to secondary runners 12, 18, and 24, are a flag bracket 26, a door latch member 28, and a body latch member 30, respectively (FIG. 3). Particularly referring to FIGS. 1 and 2, secondary runner 16 has tertiary runners 32 and 34 integrally connected to latch clips 36 and 38, respectively, for their connection to main runner member 10. Secondary runner 14 has tertiary runners 40 and 42 integrally connected to an adapter 44, and a push-pin 46, respectively, for their connection to main runner member 10. Positioned generally parallel to main runner member 10 is an indicator flag 48 shown in phantom. Generally, indicator flag 48 is an independent component separate from main runner member 10 and its auxiliary components 26, 28, 30, 36, 38, 44 and 46.

As best shown in FIG. 2, main runner member 10 has generally circular pin members 50, 53, and 56 and both secondary runners or projections 20 and 22 have pin members 52, 54, respectively, which are also generally circular. These pin members 50, 52, 53, 54, and 56 are strategically located relative to main runner member 10 and offset and spaced relative to each other so that indicator flag 48 can be wedged therebetween as best shown in FIG. 2. For added security, fastening means, such as a wire tie, a twist tie, a rubber band or similar fastening means, may be wrapped around main runner 10 and flag 48 to retain flag 48 wedged between pin members 50, 52, 53, 54, and 56.

Preferably, these auxiliary components 26, 28, 30, 36, 38, 44, and 46 are unitarily molded and integrally formed to main runner 10 via secondary runners 12, 14, 16, 18, and 24 and tertiary runners 32, 34, 40, and 42 through an injection molding process and, preferably, are made of a material which is weather resistant in that it is not adversely affected by heat or cold or ultra-violet rays but has a relatively high modulus of flexibility. Such a material may be plastic, acrylonitrile-butadience-styrene (ABS), nylon, a copolymer, or acetal, and may be selected in a specific grade to meet the required preceding criteria. The injection molding process is well-known in the art.

Preferably, the overall dimensions for the molding or casting arrangement of FIGS. 1 and 2 with runner member 10 and its several auxiliary components 26, 28, 30, 36, 38, 44, and 46 attached thereto is about 6 inches wide, about 7 inches long, and about ⅞ inches deep.

Figure 8:
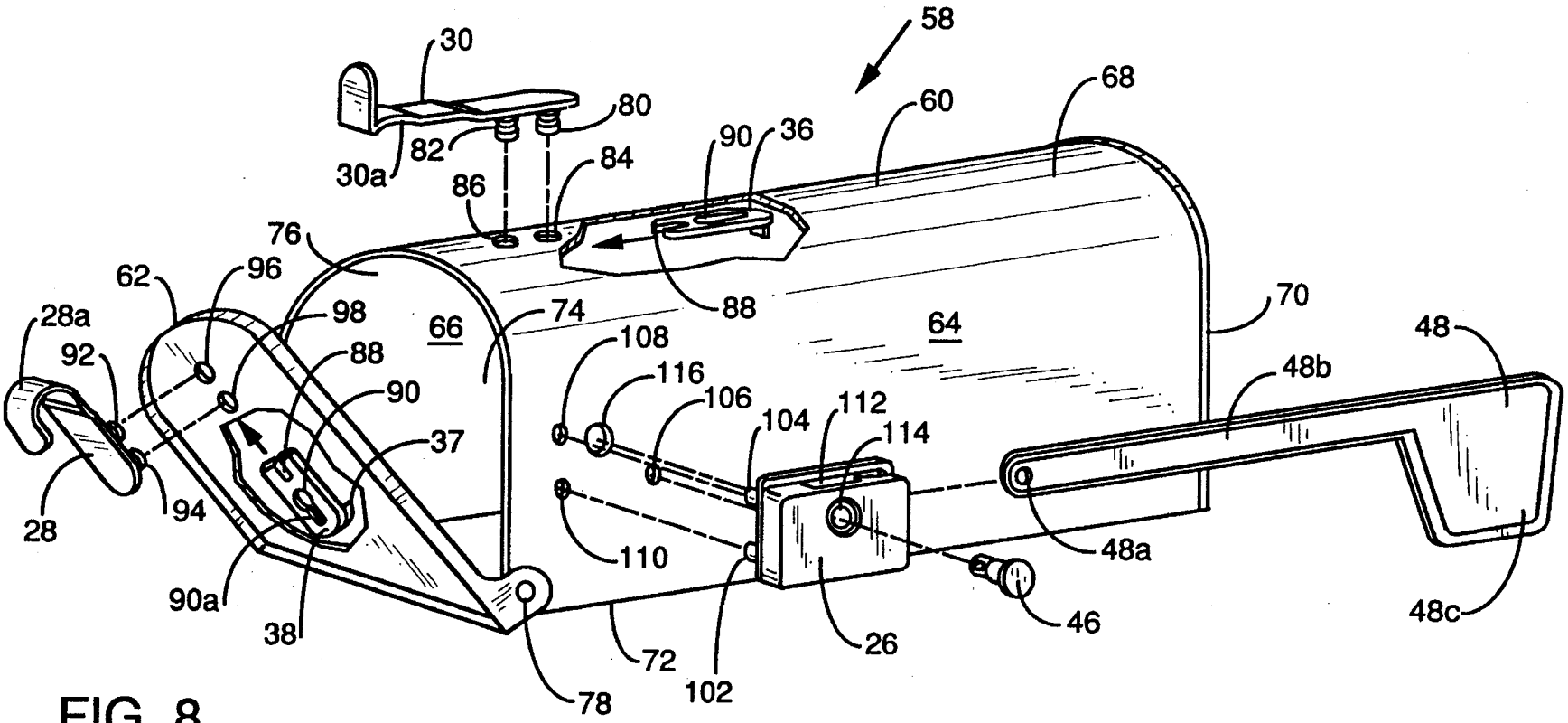
FIG. 8 is an exploded, partially broken away view of a mailbox showing the manner in which the auxiliary components of FIG. 1 are secured to a mailbox housing and to a mailbox door member.

Referring now to FIG. 8, there is shown a mailbox generally indicated at numeral 58. Mailbox 58 is broken away at at least two places in order to show latch clips 36 and 38 which are used to secure body latch member 30 and door latch member 28, respectively, to mailbox 58. Mailbox 58 comprises a mailbox housing 60 and a mailbox door member 62 pivotally connected to mailbox housing 60.

Mailbox housing 60 has lateral walls 64 and 66, a top wall 68, a rear wall 70, and a floor 72, which cooperatively define an inner compartment 74 for receiving and retaining mail and a compartment opening 76 toward the front end of the housing 60 to which mailbox door member 62 is pivotally attached through fastening means, such as pins, on both sides of mailbox door member 48, one indicated at numeral 78.

Preferably, mailbox housing 60 and door member 62 are already connected as a unit in the mailbox assembly of the present invention. If not connected, then mailbox door member 62 is easily attached to mailbox housing 60 through a pushfit process where pivot pins 78 are easily received in apertures (not shown) located the proximate lower front end of sidewalls 64, 66, of housing 60.

Still referring particularly to FIG. 8, body latch member 30 has integrally formed pins 80 and 82 with enlarged heads which are received in apertures 84 and 86, respectively, in top wall 68 of mailbox housing 60, and which body latch member 30 is secured to top wall 68 by way of latch clip 36. As particularly shown in FIGS. 1, 2, and 7, latch clips 36 and 38 each have an open slot 88 and an enclosed slot 90. In attaching body latch member 30 to top wall 68 and in referring again to FIG. 8, pin 80 of body latch member 30 is received in enclosed slot 90, and latch clip 36 is slid to the left as shown by the arrow in FIG. 8 so that pin 80 moves into a reduced, elongated portion 90*a* (best shown in FIG. 1 ) of enclosed slot 90 and pin 82 of latch member 30 can be received in open slot 88, thereby retaining latch clip 36 against the undersurface of top wall 68 of housing 60 and, thus, securing latch body member 30 to top wall 68. Latch clips 36 and 38 are identical in structure and may be interchanged for their use with either body latch member 30 or with door latch member 28.

Still referring particularly to FIG. 8, door latch member 28 also has pins 92, 94 integrally formed thereon and have enlarged heads which are received in apertures 96 and 98, respectively, of mailbox door 62 shown in FIG. 8. Door latch member 28 is secured to mailbox door member 62 by way of latch clip 38 in a manner similar to that discussed in the preceding paragraph with respect to body latch member 30 and latch clip 36. That is, after pins 92, 94 are pushed into apertures 96, 98 of door 62, latch clip pin 38 is placed on the inside surface of door 62 such that pin 94 enters enclosed slot 90. Latch clip pin 38 is then slid upwardly as shown by the arrow in FIG. 8 so that pin 94 moves into the reduced elongated portion 90*a* of enclosed slot 90 and pin 92 is received in opened slot 88 to retain door latch member 28 to door 62. In a conventional manner, door latch member 28 has a curved end portion 28*a* which is received in a cooperative curved portion 30*a* on the underside of body latch member 30 when mailbox door member 62 is closed.

Figure 7:
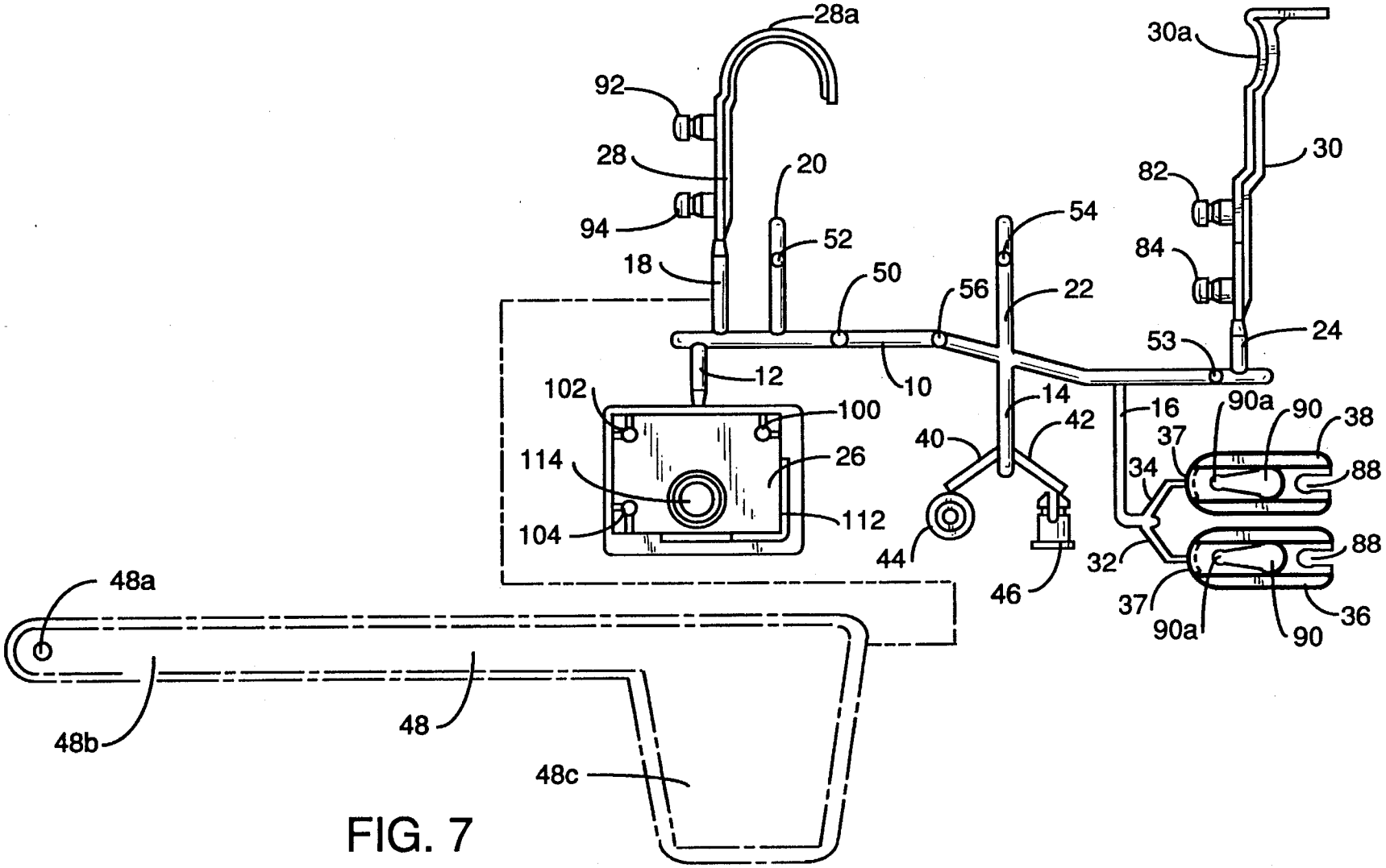
FIG. 7 is a view similar to FIG. 2 showing the flag being removed from the runner member.

Still referring particularly to FIG. 8 and the assembling of the mailbox 58 of the present invention, flag bracket 26 is broken off of its secondary runner 12 of main runner member 10 of FIGS. 1, 2, and 7. Flag bracket 26 has integral pins 100, 102, and 104 on its undersurface shown best in FIGS. 2 and 7, and which pins 100, 102, 104 are received in apertures 106, 108, 110, respectively, in lateral wall 64 of mailbox housing 60. These pins 100, 102, 104 are also integrally formed on flag bracket 26 and their ends are slightly enlarged so as to fit snugly into apertures 106, 108, 110 of housing 60 when flag bracket 26 is pushed against housing 60. Flag bracket 26 has an L-shaped slot 112 extending along its top and side when assembled on housing 60 of FIG. 8 for receiving indicator flag 48, which has an aperture 48*a* on its elongated end. When indicator flag 48 is assembled, flag 48 is inserted into slot 112 of flag bracket 26 such that its aperture 48*a* is aligned and cooperates with an aperture 114 in flag bracket 26 and an aperture 116 of mailbox housing 60. Push-pin 46 which is integrally formed and unitarily molded to runner member 10 is snapped off of its tertiary runner 42 and is inserted into aperture 114 of flag bracket 26 and into aperture 48*a* of indicator flag 48 and into aperture 116 of housing 60 to secure indicator flag 48 in flag bracket 26 for pivotal movement in the L-shaped slot 112 of flag bracket 26 in a well-known manner.

Indicator flag 48 may be made of metal, such as light weight steel, tin, or aluminum and may be finished red by painting, or may be made of plastic and may be of a red color, in a conventional manner. Flag 48 has a conventional configuration with an elongated body 48*b* and an enlarged head 48*c*, and is generally provided separately from main runner member 10 and its auxiliary components 26, 28, 30, 36, 38, 44, 46, the mailbox housing 60, and the mailbox door member 62. When packaging the mailbox assembly for shipping and/or purchasing by a consumer the several auxiliary components 26, 28, 30, 36, 38, 44, 46 formed on main runner member 10 of FIGS. 12, and 7 generally remain intact with main runner member 10, and flag 48 is secured to main runner member 10 by wedging flag 48, particularly flag head 48*c*, between pins 50, 52, 53, 54, 56 located on main runner 10 and secondary runners 20, 22 as shown best in FIG. 2. Wedging of flag 48 in the manner shown in FIGS. 1–7 as mentioned hereinabove, protects the surfaces of flag 48 and resists damage, such as scratching and/or bending, particularly to flag head 48*c*, which extends out of flag bracket 26 when assembled for public viewing. Once flag 48 is wedged in this fashion, a fastening means such as a wire tie, a twist tie, a rubber band or similar fastening means may be wrapped around this arrangement in order to assure that flag 48 remains in this positioning of FIGS. 1 and 2 relative to runner member 10. This arrangement of FIGS. 1 and 2 tends to resist damage such as scratching and/or bending to at least the top portion of flag 48 during shipment, and eliminates the need for additional packaging for the auxiliary mailbox components 26, 28, 30, 36, 38, 44, and 46.

The components of FIGS. 1–8 may constitute a mailbox assembly kit. If a kit, a set of instructions (not shown) may generally be also included in the mailbox assembly which would show the contents contained on the runner member 10 and the manner Coy illustration) in which these contents, which are generally the auxiliary components 26, 28, 30, 36, 38, 44 and 46 of FIGS. 1-8, are attached to mailbox housing 60 and to mailbox door member 62 shown in FIG. 8.

Preferably, runner member 10 with auxiliary components 26, 28, 30, 36, 38, 44 and 46 are manufactured of a plastic material by an injection molding process, but may be manufactured by die casting and made of aluminum or zinc.

After the mailbox assembly of the present invention is assembled which may be according to the provided set of instructions and the illustration of FIG. 8, the assembled mailbox 58 can be mounted on a post in a conventional manner according to the height and placement regulations of the local post office for use by the consumer.

In certain situations, and for some models of mailboxes encompassed in the mailbox assembly of the present invention, adapter 44, which may be a bushing, and a wood screw is used instead of push pin 46 for securing flag 48 in flag bracket 26 and mailbox housing 60. Adapter 44 may be formed instead of or in addition to push pin 46 during the manufacturing process of runner member 10 of the FIGS. 1–7. The mailbox 58 of the mailbox assembly of the present invention may be assembled according to the following instructions:

Remove flag 48 from runner member 10. Remove body latch member 30 and latch clip 36 from main runner member 10. Position body latch member 30 above top wall 68 of housing 60 such that curved portion 30*a* of latch member 30 is in a cantilevered position on housing 60 as shown in FIG. 8 while inserting pins 80 and 82 of latch member 30 into apertures 84, 86, respectively, on top wall 68 of housing 60. Insert pin 80 into enclosed slot 90 of latch clip 36, and while sliding latch clip 36 forwardly toward the front end of housing 60, snap pin 82 of latch member 30 into opened slot 88 of latch clip 36 such that latch clip 36 snaps into place against the underside surface of top wall 60. Remove door latch member 28 and latch clip 38 from main runner member 10. Position door latch member 28 against the outside surface of door member 62 as shown in FIG. 8. Push pins 92, 94 of door latch member 28 are received in apertures 96, 98, respectively, of door member 62 such that curved portion 28*a* of door latch member 28 extends beyond the top of door member 62, as shown in FIG. 8. Place latch clip 38 against the inside surface of door member 62 such that pin 94 of door latch member 28 is received in enclosed slot 90 of latch clip 38, and while sliding latch clip 38 upwardly toward the top of door member 62, insert pin 92 into opened slot 88 of latch clip 38 until latch clip 38 snaps into place against the inside surface of door member 62. Install flag bracket 26 against lateral wall 64 by aligning pins 100, 102, 104 of flag bracket 26 with its respective aperture 106, 108, 110 of housing 60 and pushing flag bracket 26 against housing 60 until pins 100, 102, 104 enter apertures 106, 108, 110. Insert flag 48 into flag bracket 26 and align its aperture 48*a* with aperture 114 of flag bracket 26 and with aperture 116 of housing 60, and after removing push-pin 46 from runner member 10, press push-pin 46 firmly into apertures 114, 48*a*, and 116 until push-pin 46 clicks into place.

As mentioned hereinabove, adapter 44 and a wood screw may alternately be used in place of push-pin 46 for certain models of the mailbox assembly of the present invention. Once the mailbox 58 is assembled, it is ready for installation on a mounting post or other suitable mounting means.

With reference to latch clip members 36 and 38, these clips 36, 38 may be used for applications other than disclosed herein. As shown in FIGS. 1, 2, and 7, these clips members 36, 38 also have a ledge 37 for ease in handling and sliding clip members 36, 38 along the mailbox surfaces in assembly of mailbox 58. Preferably, the length of pins 50, 52, 53, 54 and 56 is about the same so as to evenly raise runner member 10 with its components 26, 28, 30, 36, 38, 44 and 46 when runner member 10 is placed on a horizontal surface, and is greater than the thickness of flag 48 so as to protect flag 48 from damage. Also, even though not shown, additional pins, similar to pins 50, 52, 53, 54, and 56 may be provided along runner member 10 and its several secondary and tertiary runners or projections.

Whereas particular embodiments of the invention have been described above for purposes of illustration, it will be appreciated by those skilled in the art that numerous variations of the details may be made without departing from the invention as described in the appended claims.

In accordance with the patent statutes we have explained the principles and operation of our invention and have illustrated and described what we consider to be the best embodiments thereof.

What is claimed is:

1. A kit for constructing a rural mailbox containing a plurality of auxiliary components, comprising:

a mailbox housing defining an inner compartment, a mailbox door pivotally connected to said housing, runner means being integrally formed and unitarily molded to at least some of said auxiliary components, which said auxiliary components are disconnected from said runner means for said assembling of said mailbox, cooperating latch means attachable to said mailbox housing and to said mailbox door member for latching said door member against said mailbox housing, fastening means for securing said cooperating latch means to said mailbox, said fastening means including pin means on said latch means receivable into tapered closed slot means formed in cooperating latch clip means, whereby said latch means will be fixedly secured to said mailbox through mechanical engagement between said pin means within said latch clip means tapered slot.

2. The mailbox kit of claim 1 including said latch means including first and second latch members each having pin means with at least two pins projecting in generally the same direction, and said clip means having first and second clip members each structured to be secured to one of said latch members.

3. The mailbox kit of claim 2 including each of said clip members having an open ended slot for engaging one said pin.

4. The mailbox kit of claim 3 including said pins having enlarged heads for facilitating intimate interengagement with said clip members.

5. A kit for constructing a mailbox, comprising a mailbox housing defining an inner compartment, a mailbox door pivotally connected to said mailbox housing, runner means being integrally formed and unitary molded to at least some of said auxiliary components, which said auxiliary components are disconnected from said runner means for said assembling of said mailbox, said auxiliary components comprise indicator flag means which is an individual component separate from said runner means, and wherein said runner means further includes a plurality of pin means integrally formed and unitarily molded thereto along several locations on said runner means, whereby said indicator flag means is wedged between said pin means to secure said indicator flag means to said runner means.

6. A mailbox assembly of claim 5, wherein said runner means and said plurality of auxiliary components are formed by an injection molding process and are made of a plastic material.

7. A mailbox assembly of claim 6, wherein said runner means includes a central rod-like member and a plurality of projection means arranged along opposed sides thereof, and wherein said auxiliary components are integrally formed on said projection means.

8. A mailbox assembly of claim 5 wherein said runner means and said auxiliary components have an overall dimension of about 6 inches wide, about 7 inches long, and about ⅞ inches deep.

9. A mailbox assembly of claim 5 wherein said indicator flag means is made of a material selected from the group consisting of plastic and metal.

10. A mailbox assembly of claim 5 wherein said indicator flag means is an individual component separate from said auxiliary components and is made of a material selected from the group consisting of light weight steel, tin, and aluminum.

11. A kit for constructing a mailbox, comprising a mailbox housing defining an inner compartment, a mailbox door pivotally connected to said housing, runner means being integrally formed and unitary molded to at least some of said auxiliary components, which said auxiliary components are disconnected from said runner means for said assembling of said mailbox, said auxiliary components comprise flag bracket means attachable to said mailbox housing, indicator flag means receivable in said flag bracket means and mountable therein for pivotal movement, cooperating latch means attachable to said mailbox housing and to said mailbox door member for latching said door member against said mailbox housing, and fastening means for securing said flag bracket means, said indicator flag means, and said cooperating latch means to said mailbox.

12. The mailbox kit of claim 11 wherein said mailbox housing, said flag bracket means, and said indicator flag means each include cooperating apertures arranged in an aligned fashion, and wherein said fastening means includes a push-pin received in said aligned, cooperating apertures for securing said flag bracket means and said indicator flag means to said mailbox housing.

13. The mailbox kit of claim 11 wherein said cooperating latch means has pin means which extend into said mailbox, and wherein said fastening means for securing said cooperating latch means to said mailbox includes latch clip means comprising slot means for receiving said pin means of said cooperating latch means.

14. The mailbox kit of claim 13 wherein said pin means of said cooperating latch means includes at least two pin elements and wherein said slot means of said latch clip means includes an enclosed elongated slot for receiving a first of said pin elements and an open ended generally circular slot for receiving a second of said pin elements.

15. The mailbox kit of claim 14, wherein said cooperating latch means includes a first latch member and a second latch member, wherein said latch clip means includes a first latch clip member for attaching said first latch member to said mailbox housing and a second latch clip member for attaching said second latch member to said door member, and wherein said first latch clip member and said second latch clip member are similarly constructed to be interchangeable with each other with respect to said first latch member and said second latch member.

16. A kit for constructing a mailbox, comprising a mailbox housing defining an inner compartment, a mailbox door pivotally connected to said housing, runner means being integrally formed and unitary molded to at least some of said auxiliary components which said auxiliary components are disconnected from said runner means for said assembling of said mailbox, said runner means and said plurality of auxiliary components are formed by an injection molding process and are made of a plastic material, said runner means includes a central rod-like member and a plurality of projection means arranged along opposed sides thereof, and wherein said auxiliary components are integrally formed on said projection means, and said auxiliary components comprise flag bracket means, cooperating latch means, latch clip means, and fastening means, and wherein at least said flag bracket means, said latch clip means, and said fastening means are integrally formed on said projection means located on a first of said opposed sides of said central rod-like member and at least said cooperating latch means are integrally formed on said projection means located on a second of said opposed sides of said central rod-like member.

17. A kit for constructing a mailbox, comprising a mailbox housing defining an inner compartment, a mailbox door pivotally connected to said housing, runner means being integrally formed and unitary molded to at least some of said auxiliary components, which said auxiliary components are disconnected from said runner means for said assembling of said mailbox, said runner means and said plurality of auxiliary components are formed by an injection molding process and are made of a plastic material, said runner means includes a central rod-like member and a plurality of projection means arranged along opposed sides thereof, and wherein said auxiliary components are integrally formed on said projection means, and indicator flag means, and wherein said runner means further comprises pin means integrally formed on said projection means for securing said indicator flag means to said runner means.

18. A kit for constructing a rural mailbox comprising:

a mailbox housing having lateral walls, a top wall, and a floor cooperatively defining an inner compartment opening toward a front end of said housing, at least one of said lateral walls and said top wall having apertures proximate said front end, a mailbox door member positionable against said front end of said mailbox housing, said door member having apertures, flag bracket means attachable in said apertures of said at least one of said lateral walls of said housing, indicator flag means receivable in said flag bracket means and secured therein for pivotal movement therein, and for visually indicating the presence of mail within said mailbox housing upon said pivotal movement of said indicator flag means when in said flag bracket means, fastening means receivable in said apertures of said lateral walls of said mailbox housing for securing said indicator flag means in said flag bracket means and to said mailbox housing, cooperating latch means including a first latch member having pin means receivable in said apertures in said top wall of said housing and a second latch member having pin means receivable in said apertures of said mailbox door member, latch clip means including a first latch clip member associated with said pin means of said first latch member for attaching said first latch member to said housing and a second latch clip member associated with said pin means of said second latch member for attaching said second latch member to said door member, and runner means integrally formed and unitarily molded to at least said flag bracket means, said cooperating latch means, said latch clip means, and said fastening means for packaging said runner means with said mailbox and thereafter for disconnecting said flag bracket means, said cooperating latch means, said latch clip means, and said fastening means upon the assembling of said mailbox.

19. The mailbox kit of claim 18 wherein at least said runner means, said flag bracket means, said cooperating latch means, said latch clip means, and said fastening means are integrally formed through an injection molding process and are made of a plastic material.

20. The mailbox of claim 18 wherein said indicator flag means is an individual component separate from said runner means, and wherein said pin means are located at several locations on said runner means and integrally formed thereto, whereby said flag means is wedged between said pin means for securing said indicator flag means to said runner means for said packaging of said runner means with said mailbox.

21. The mailbox kit of claim 18 wherein said runner means includes a central rod-like member and a plurality of projection means along opposed sides of said central rod-like member, and wherein at least said flag bracket means, said cooperating latch means, said latch clip means, and said fastening means are integrally formed on said projection means.

22. The mailbox kit of claim 21 wherein at least said flag bracket means, said latch clip means, and said fastening means are integrally formed on said projection means located on a first of said opposed sides, and at least said cooperating latch means are integrally formed on said projection means located on a second of said opposed sides of said central rod-like member.

23. The mailbox of claim 22 wherein said pin means are integrally formed on said projection means for securing said indicator flag means to said runner means.

24. The mailbox kit of claim 18 wherein said first latch clip member and said second latch clip member are similarly constructed to be interchangeable with each other with respect to said first latch member and said second latch member.

25. The mailbox kit of claim 18 wherein said flag means is made of a material selected from the group consisting of plastic, light weight steel, tin, and aluminum.

26. The mailbox kit of claim 18 wherein said first latch clip member and said second latch clip member each comprise an enclosed elongated slot and an opened generally circular slot for receiving said pin means of said first latch member and said second latch member, respectively.

27. A method of assembling a rural mailbox having a housing with apertures on top of said housing and a pivotal door having apertures and used for opening and closing said housing, and a flag for signalling the receipt of mail, the steps comprising:

providing runner means supporting body latch means with pin means, door latch means with pin means, flag bracket means, first and second latch clip means, and push-pin means for securing said flag and said flag bracket means to said housing, removing said body latch means and at least one of said latch clip means from said runner means, placing said body latch means on said top of said housing while inserting said pin means of said body latch means into said housing and placing said first latch clip means inside said housing and attaching said first latch clip means to said pin means of said body latch means for securing said body latch means to said top of said housing, removing said door latch means and said second latch clip means from said runner means, placing said door latch means on the outside of said door means while inserting said pin means of said door latch means into said aperture means on said door means and placing said second latch clip means on an inside surface of said door means and attaching said second latch clip means to said pin means of said door latch means for securing said door latch means on said door means so that when said door means is in a closed position said door latch means engages said body latch means for retaining said door means in said closed position, removing said flag bracket means from said runner means, placing said flag bracket means against said side of said housing in alignment with said aperture means of said housing, inserting said flag in said flag bracket means and aligning said flag with said aperture means in said housing, and inserting said push-pin means into said aperture means of said flag bracket means, through said flag, and into said housing to secure said flag in said flag bracket means and against said housing for pivotal movement of said flag in said flag bracket means.

28. A method of claim 27, the steps further comprising:

providing pin means at several locations on said runner means whereby said flag is wedged therebetween, and in said assembling of said mailbox, removing said flag from between said pin means prior to said inserting of said flag in said bracket means.

29. A method of claim 28, the steps further comprising:

integrally forming at least said runner means with said body latch means, said door latch means, said flag bracket means, said first and second latch clip means, said push-pin means, and said pin means through a plastic injection molding process.

30. A method of assembling a plurality of auxiliary components onto a rural mailbox having a mailbox housing and a mailbox door pivotally connected to said housing, the steps comprising:

providing runner means with said auxiliary components unitarily molded and integrally formed thereon, removing said auxiliary components individually from said runner means and interconnecting said auxiliary components onto said mailbox housing and said mailbox door, providing an indicator flag as an individual element separate from said runner means and said auxiliary components, providing pin means at several locations on said runner means and wedging said indicator flag therebetween prior to said assembling of said auxiliary components onto said mailbox, and removing said flag from between said pin means and connecting said flag to said mailbox housing for said securing of said indicator flag to said mailbox housing.

31. A method of packaging a mailbox assembly containing a plurality of auxiliary components, the steps comprising:

providing a mailbox housing, a mailbox door pivotally attachable to said housing, and a flag attachable to said housing, providing runner means with said auxiliary components being unitarily molded and integrally formed on said runner means, providing pin means at several locations on said runner means being unitarily molded and integrally formed on said runner means, and securing said flag to said pin means of said runner means to resist damage to said flag during shipping of said mailbox assembly.

32. A method of claim 31 wherein said flag is an individual component separately formed from said runner means and said auxiliary components, and wherein said securing of said flag includes wedging said flag between said pin means.

* * * * *